US010710366B2

(12) United States Patent
Hirata et al.

(10) Patent No.: US 10,710,366 B2
(45) Date of Patent: Jul. 14, 2020

(54) JET HOLE PLATE, LIQUID JET HEAD, AND LIQUID JET RECORDING APPARATUS

(71) Applicant: SII Printek Inc., Chiba-shi, Chiba (JP)

(72) Inventors: Masakazu Hirata, Chiba (JP); Kenji Takano, Chiba (JP); Emiko Osaka, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 16/189,330

(22) Filed: Nov. 13, 2018

(65) Prior Publication Data

US 2019/0143686 A1 May 16, 2019

(30) Foreign Application Priority Data

Nov. 14, 2017 (JP) ..... 2017-218697

(51) Int. Cl.

| | |
|---|---|
| ***B41J 2/14*** | (2006.01) |
| ***B41J 2/165*** | (2006.01) |
| ***B41J 2/16*** | (2006.01) |
| ***B41J 2/21*** | (2006.01) |

(52) U.S. Cl.

CPC ..... *B41J 2/1433* (2013.01); *B41J 2/14209* (2013.01); *B41J 2/162* (2013.01); *B41J 2/1606* (2013.01); *B41J 2/16517* (2013.01)

(58) Field of Classification Search

CPC ..... B41J 2/162; B41J 2/1433

See application file for complete search history.

(56) References Cited

U.S. PATENT DOCUMENTS

| | | | | |
|---|---|---|---|---|
| 5,549,768 | A * | 8/1996 | Mahoney | C21D 7/04 148/695 |
| 5,574,486 | A * | 11/1996 | Whitlow | B41J 2/1606 205/646 |
| 6,170,934 | B1 | 1/2001 | Fukisawa et al. | |
| 2003/0210299 | A1* | 11/2003 | Min | B41J 2/14137 347/47 |
| 2006/0012656 | A1* | 1/2006 | Suzuki | B41J 2/1606 347/100 |
| 2008/0286597 | A1* | 11/2008 | Umemoto | B23B 1/00 428/553 |

FOREIGN PATENT DOCUMENTS

| | | | |
|---|---|---|---|
| EP | 1707306 | A1 | 10/2006 |
| EP | 3184307 | A1 | 6/2017 |
| JP | H10-226070 | A | 8/1998 |

OTHER PUBLICATIONS

Shiratori et al., "Deformation and transformation behavior in micropiercing of SUS304," Sep. 2018, 17th International Conference on Metal Forming, Metal Forming 2018 (Year: 2018).*

Extended European Search Report in Europe Application No. 18206315.6, dated Apr. 1, 2019, 7 pages.

* cited by examiner

*Primary Examiner* — Shelby L Fidler

(74) *Attorney, Agent, or Firm* — Brinks Gilson & Lione

(57) ABSTRACT

Provided herein are a jet hole plate, a liquid jet head, and a liquid jet recording apparatus that can achieve a long life. A jet hole plate according to an embodiment of the present disclosure is a jet hole plate for use in a liquid jet head. The jet hole plate includes a metal substrate provided with a plurality of jet holes. In the metal substrate, an average crystal grain size in outlet edges of the jet holes is smaller than that in surrounding regions around the outlet edges.

9 Claims, 7 Drawing Sheets

JET HOLE PLATE, LIQUID JET HEAD, AND LIQUID JET RECORDING APPARATUS

RELATED APPLICATIONS

This application claims priority under 35 U.S.C. § 119 to Japanese Patent Application No. 2017-218697 filed on Nov. 14, 2017, the entire content of which is hereby incorporated by reference.

BACKGROUND OF THE INVENTION

1. Field of the Invention

The present disclosure relates to a jet hole plate, a liquid jet head, and a liquid jet recording apparatus.

2. Description of the Related Art

A liquid jet recording apparatus equipped with a liquid jet head is in wide use.

A liquid jet head includes a plurality of laminated plates including a jet hole plate formed with large numbers of jet holes, and is configured to eject liquid, specifically, ink, against a target recording medium through the jet holes. Such a jet hole plate is formed by, for example, press working of a metal substrate (see, for example, JP-A-H10-226070).

SUMMARY OF THE INVENTION

There is a common demand for a long-lasting jet hole plate. It is accordingly desirable to provide a jet hole plate, a liquid jet head, and a liquid jet recording apparatus that can achieve a long life.

A jet hole plate according to an aspect of the present disclosure is a jet hole plate for use in a liquid jet head. The jet hole plate includes a metal substrate provided with a plurality of jet holes. In the metal substrate, an average crystal grain size in outlet edges of the jet holes is smaller than that in surrounding regions around the outlet edges.

A liquid jet head according to an aspect of the present disclosure includes the jet hole plate.

A liquid jet recording apparatus according to an aspect of the present disclosure includes the liquid jet head, and a container for storing a liquid to be supplied to the liquid jet head.

The jet hole plate, the liquid jet head, and the liquid jet recording apparatus according to the aspects of the present disclosure can achieve a long life.

DETAILED DESCRIPTION OF THE PREFERRED EMBODIMENTS

An embodiment of the present disclosure is described below, with reference to the accompanying drawings. Descriptions are given in the following order.

1. Embodiment (Nozzle Plate, Inkjet Head, and Printer)
2. Variations

1. Embodiment

Overall Configuration of Printer 1

Figure 1:
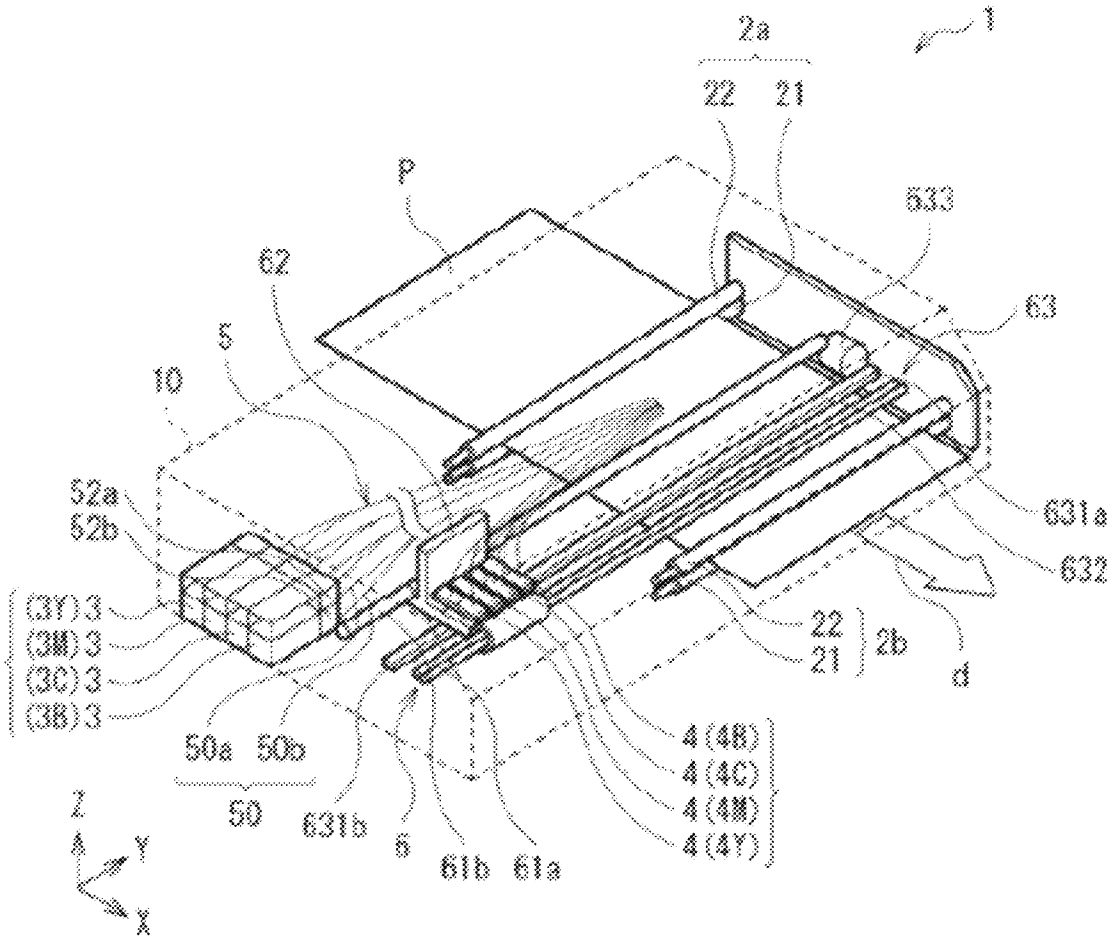
FIG. 1 is a perspective view schematically representing an example of a structure of a liquid jet recording apparatus according to an embodiment of the present disclosure.

FIG. 1 is a perspective view schematically representing an example of a structure of a printer 1 as a liquid jet recording apparatus according to an embodiment of the present disclosure. The printer 1 is an inkjet printer that records (prints) an image, texts, and the like on recording paper P (target recording medium), using an ink 9 (described later). The printer 1 is also an ink-circulating inkjet printer that circulates the ink 9 through a predetermined channel, as will be described later in detail.

As illustrated in FIG. 1, the printer 1 includes a pair of transport mechanisms 2*a* and 2*b*, ink tanks 3, inkjet heads 4, a circulation mechanism 5, and a scan mechanism 6. These members are housed in a housing 10 of a predetermined shape. The drawings referred to in the descriptions of the specification are appropriately scaled to show members in sizes that are easily recognizable. The printer 1 corresponds to a specific example of a liquid jet recording apparatus of the present disclosure. The inkjet heads 4 (inkjet heads 4Y, 4M, 4C, and 4B; described later) correspond to a specific example of a liquid jet head of the present disclosure.

Transport Mechanisms 2*a* and 2*b*

The transport mechanisms 2*a* and 2*b*, as shown in FIG. 1, are mechanisms that transport recording paper P along a transport direction d (X-axis direction). The transport mechanisms 2*a* and 2*b* each include a grid roller 21, a pinch roller 22, and a drive mechanism (not illustrated). The grid rollers 21 and the pinch rollers 22 extend along the Y-axis direction (width direction of recording paper P). The drive mechanisms rotate the grid rollers 21 about the roller axis (within a Z-X plane), and are configured by using, for example, a motor.

Ink Tanks 3

The ink tanks 3 store the ink 9 (liquid) to be supplied to the inkjet heads 4. That is, the ink tanks 3 are storages for ink 9. In this example, as shown in FIG. 1, the ink tanks 3 are four separate tanks storing the inks 9 of four different colors: yellow (Y), magenta (M), cyan (C), and black (B). Specifically, the ink tanks 3 are an ink tank 3Y storing a yellow ink 9, an ink tank 3M storing a magenta ink 9, an ink tank 3C storing a cyan ink 9, and an ink tank 3B storing a black ink 9. The ink tanks 3Y, 3M, 3C, and 3B are disposed side by side in the housing 10 along X-axis direction. The ink tanks 3Y, 3M, 3C, and 3B have the same configuration, except for the color of the ink 9 stored therein, and accordingly will be collectively referred to as ink tank 3.

Inkjet Heads 4

The inkjet heads 4 record an image, texts, and the like by jetting (ejecting) the ink 9 against recording paper P in the form of droplets through a plurality of nozzle holes (nozzle holes H1 and H2; described later). In this example, as shown in FIG. 1, the inkjet heads 4 are four separate inkjet heads that jet the inks 9 of four different colors stored in the ink tanks 3Y, 3M, 3C, and 3B. That is, the inkjet heads 4 are the inkjet head 4Y for jetting the yellow ink 9, the inkjet head 4M for jetting the magenta ink 9, the inkjet head 4C for jetting the cyan ink 9, and the inkjet head 4B for jetting the black ink 9. The inkjet heads 4Y, 4M, 4C, and 4B are disposed side by side in the housing 10 along Y-axis direction.

Figure 3:
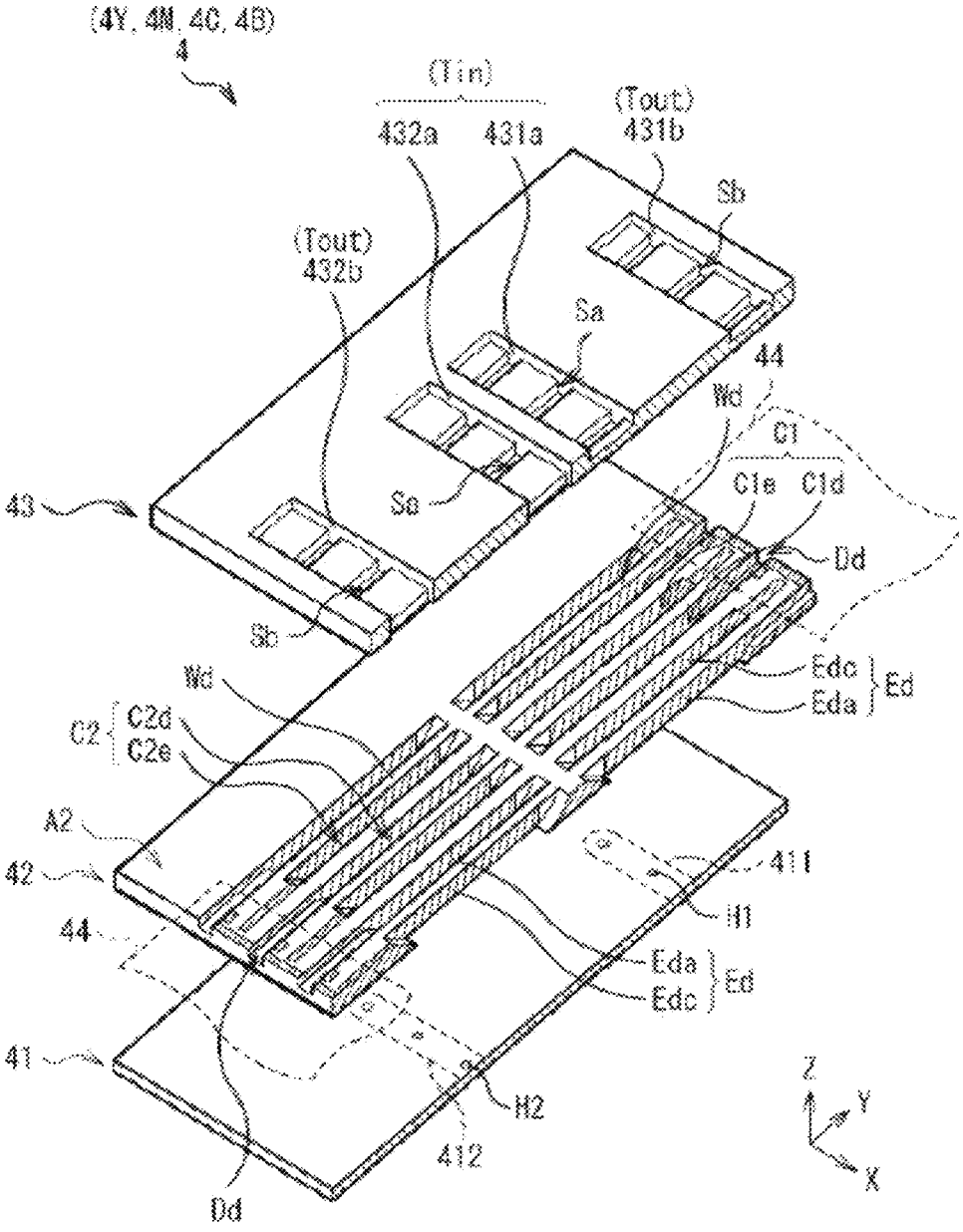
FIG. 3 is an exploded perspective view representing an exemplary structure of a liquid jet head of FIG. 2 in detail.
Figure 4:
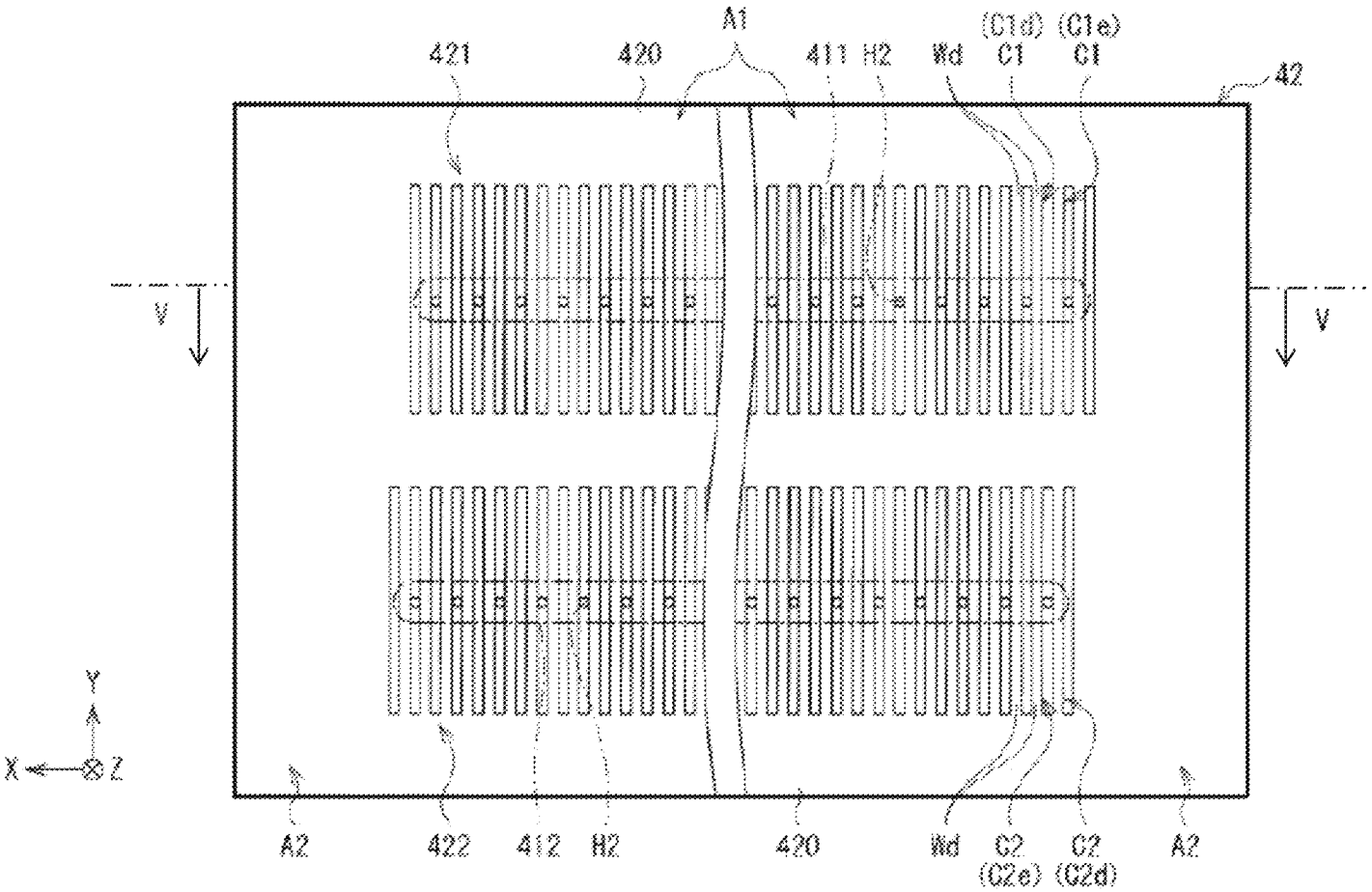
FIG. 4 schematically shows a bottom view of the exemplary structure of the liquid jet head, without a nozzle plate shown in FIG. 3.
Figure 5:
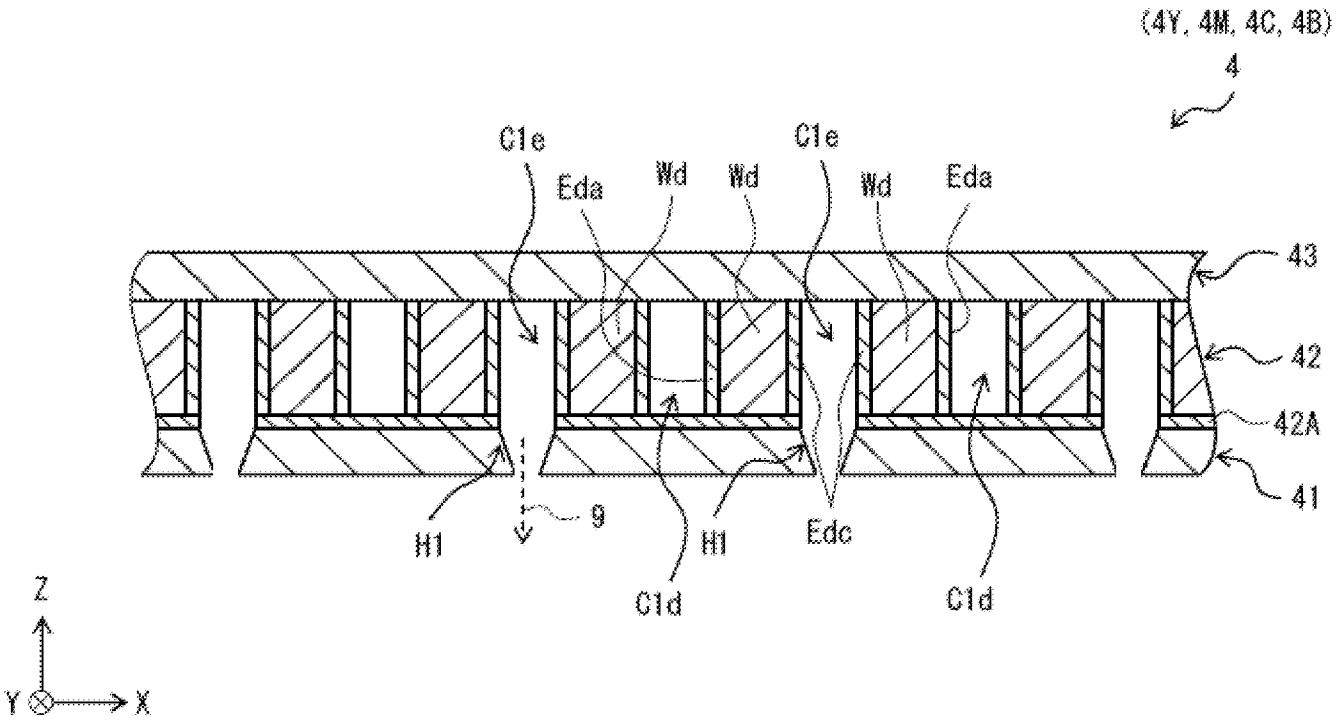
FIG. 5 is a schematic diagram showing a partial cross section of the exemplary structure at line V-V of FIG. 4.

The inkjet heads 4Y, 4M, 4C, and 4B have the same configuration, except for the color of the ink 9 to be used, and accordingly will be collectively referred to as inkjet head 4. The configuration of the inkjet heads 4 will be described later in greater detail (FIGS. 3 to 5).

Circulation Mechanism 5

Figure 2:
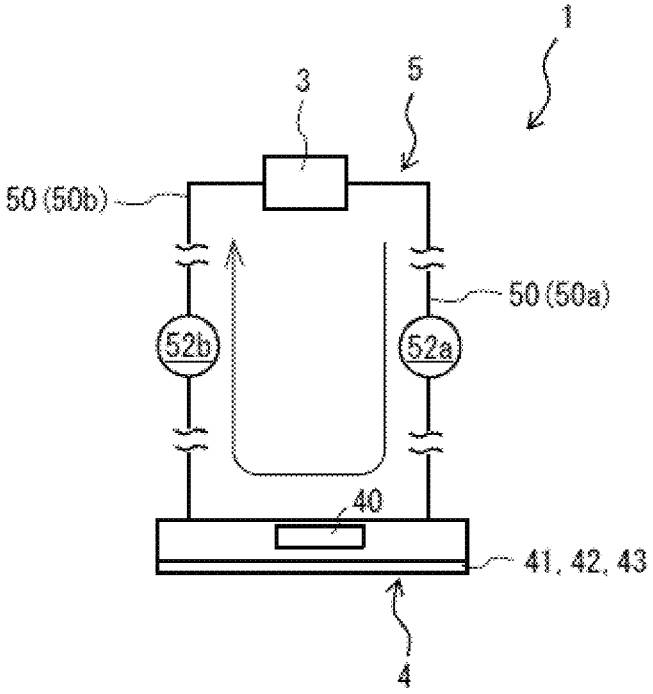
FIG. 2 schematically represents an exemplary detailed structure of a circulation mechanism and other members shown in FIG. 1.

The circulation mechanism 5 is a mechanism for circulating the ink 9 between the ink tank 3 and the inkjet head 4. FIG. 2 schematically represents an exemplary structure of the circulation mechanism 5, together with the ink tank 3 and the inkjet head 4. The solid arrow in FIG. 2 indicates the direction of circulation of the ink 9. As shown in FIG. 2, the circulation mechanism 5 includes a predetermined channel (circulation channel 50), and a pair of delivery pumps 52*a* and 52*b* for circulating the ink 9.

The circulation channel 50 is a channel through which the ink 9 circulates between the inkjet head 4 and outside of the inkjet head 4 (inside the ink tank 3). The circulation channel 50 has a channel 50*a* that connects the ink tank 3 to the inkjet head 4, and a channel 50*b* that connects the inkjet head 4 to the ink tank 3. In other words, the channel 50*a* is a channel through which the ink 9 travels from the ink tank 3 to the inkjet head 4, and the channel 50*b* is a channel through which the ink 9 travels from the inkjet head 4 to the ink tank 3.

The delivery pump 52*a* is disposed between the ink tank 3 and the inkjet head 4 on the channel 50*a*. The delivery pump 52*a* is a pump for delivering the stored ink 9 in the ink tank 3 to the inkjet head 4 via the channel 50*a*. The delivery pump 52*b* is disposed between the inkjet head 4 and the ink tank 3 on the channel 50*b*. The delivery pump 52*b* is a pump for delivering the stored ink 9 in the inkjet head 4 to the ink tank 3 through the channel 50*b*.

Scan Mechanism 6

The scan mechanism 6 is a mechanism for scanning the inkjet head 4 along the width direction (Y-axis direction) of recording paper P. As illustrated in FIG. 1, the scan mechanism 6 includes a pair of guide rails 61*a* and 61*b* extending along the Y-axis direction, a carriage 62 movably supported on the guide rails 61*a* and 61*b*, and a drive mechanism 63 for moving the carriage 62 along the Y-axis direction. The drive mechanism 63 includes a pair of pulleys 631*a* and 631*b* disposed between the guide rails 61*a* and 61*b*, an endless belt 632 suspended between the pulleys 631*a* and 631*b*, and a drive motor 633 for driving and rotating the pulley 631*a*.

The pulleys 631*a* and 631*b* are disposed in regions corresponding to the vicinity of end portions of the guide rails 61*a* and 61*b*, respectively, along the Y-axis direction. The carriage 62 is joined to the endless belt 632. The four inkjet heads 4Y, 4M, 4C, and 4B are disposed side by side on the carriage 62, along the Y-axis direction. The scan mechanism 6, together with the transport mechanisms 2*a* and 2*b*, constitutes a moving mechanism for moving the inkjet heads 4 and the recording paper P relative to each other.

Detailed Configuration of Inkjet Head 4

The following specifically describes an exemplary structure of the inkjet head 4, with reference to FIGS. 1 and 2, and FIGS. 3 to 5. FIG. 3 is an exploded perspective view showing an exemplary structure of the inkjet head 4 in detail. FIG. 4 schematically shows a bottom view (X-Y bottom view) of the exemplary structure of the inkjet head 4, without a nozzle plate 41 (described later) shown in FIG. 3. FIG. 5 is a schematic diagram showing a partial cross section (Z-X cross section) of the inkjet head 4 taken at line V-V of FIG. 4.

The inkjet head 4 of the present embodiment is what is generally called a side shoot-type inkjet head, and ejects the ink 9 from a central portion in the direction of extension (Y-axis direction) of a plurality of channels (channels C1 and C2; described later). The inkjet head 4 is also a circulatory inkjet head, allowing the ink 9 to circulate to and from the ink tank 3 to be used with the use of the circulation mechanism 5 (circulation channel 50).

As illustrated in FIG. 3, the inkjet head 4 mainly includes the nozzle plate 41 (jet hole plate), an actuator plate 42, and a cover plate 43. The nozzle plate 41, the actuator plate 42, and the cover plate 43 are bonded to each other using, for example, an adhesive, and are laminated in Z-axis direction, in this order. In the following, the "top" of the inkjet head 4 is on the side of the cover plate 43, and the "bottom" of the inkjet head 4 is on the side the nozzle plate 41, relative to Z-axis direction. The nozzle plate 41 corresponds to a specific example of a jet hole plate of the present disclosure.

Nozzle Plate 41

The nozzle plate 41 is a plate used for the inkjet head 4. The nozzle plate 41 has a metal substrate having a thickness of, for example, about 50 μm, and is bonded to the bottom surface of the actuator plate 42, as shown in FIG. 3. The metal substrate used for the nozzle plate 41 is, for example, a stainless steel such as SUS316 and SUS304. As illustrated in FIGS. 3 and 4, the nozzle plate 41 (metal substrate) has two rows of nozzles (nozzle rows 411 and 412) extending along the X-axis direction. The nozzle rows 411 and 412 are disposed by being separated from each other in Y-axis direction by a predetermined distance. That is, the inkjet head 4 of the present embodiment is a two-row inkjet head. A method of manufacture of the nozzle plate 41 will be described later in detail.

The nozzle row 411 has a plurality of nozzle holes (jet holes) H1 that are disposed in a straight line by being separated from each other in X-axis direction by a predetermined distance. The nozzle holes H1 penetrate through the nozzle plate 41 in thickness direction (Z-axis direction), and are in communication with, for example, ejection channels C1*e* of the actuator plate 42 (described later), as shown in FIG. 5. Specifically, as illustrated in FIG. 4, the nozzle holes H1 correspond in position to a central portion of the ejection channels C1*e* relative to Y-axis direction. The pitch of the nozzle holes H1 along X-axis direction is the same as the pitch of the ejection channels C1*e* along X-axis direction. The ink 9 supplied through ejection channels C1*e* is ejected (jetted) out of the nozzle holes H1 of the nozzle row 411, as will be described later in detail.

As with the case of the nozzle row 411, the nozzle row 412 has a plurality of nozzle holes (jet holes) H2 that are disposed in a straight line by being separated from each other in X-axis direction by a predetermined distance. The nozzle holes H2 penetrate through the nozzle plate 41 in thickness direction (Z-axis direction), and are in communication with, for example, ejection channels C2*e* of the actuator plate 42 (described later). Specifically, as illustrated in FIG. 4, the nozzle holes H2 correspond in position to a central portion of the ejection channels C2*e* relative to Y-axis direction. The pitch of the nozzle holes H2 along X-axis direction is the same as the pitch of the ejection channels C2*e* along X-axis direction. The ink 9 supplied through the ejection channels C2*e* is ejected out of the nozzle holes H2 of the nozzle row 412, as will be described later in detail.

Figure 6:
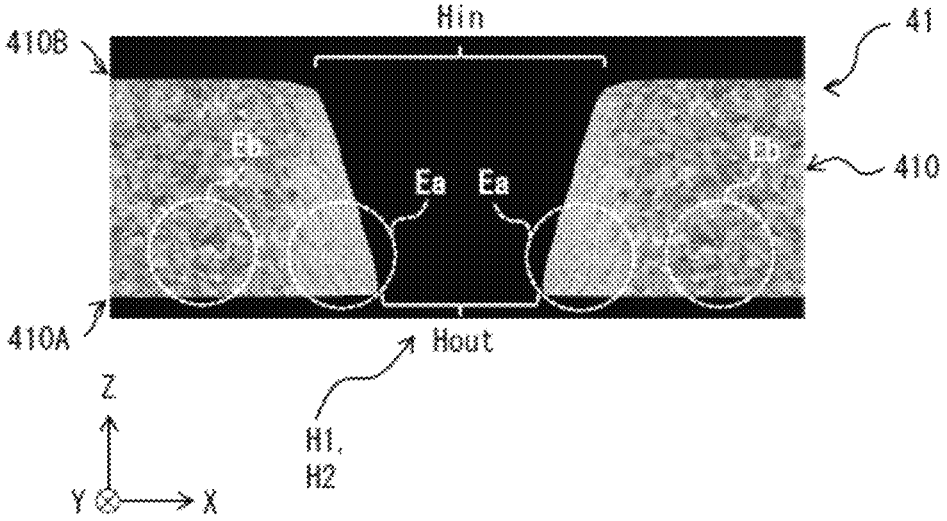
FIG. 6 is a partially enlarged SEM (electron scanning microscope) cross sectional view of the nozzle plate of FIG. 3.

FIG. 6 is a partially enlarged SEM (electron scanning microscope) cross sectional view (Z-X cross sectional view) of the nozzle plate 41. The nozzle plate 41 has a metal substrate 410 provided with the plurality of nozzle holes H1, and the plurality of nozzle holes H2. The metal substrate 410 has an outlet-side principal surface 410A (first principal surface) provided with outlets Hout for the nozzle holes H1 and H2, and an inlet-side principal surface 410B (second principal surface) provided with inlets Hin, larger than the outlets Hout, provided for the nozzle holes H1 and H2. The nozzle holes H1 and H2 are tapered through holes of gradually decreasing diameter toward the bottom. In the metal substrate 410, the average size D1 of crystal grains in outlet edges Ea of the nozzle holes H1 and H2 is smaller than the average size D2 of crystal grains in surrounding regions Eb around the outlet edges Ea (formula (1)). Here, the outlet edge Ea corresponds to a region of the metal substrate 100 opposite the inlet Hin in a thickness direction of the metal substrate 100. The average size D1 may be equal to or less than half of the average size D2 (formula (2)). The average size D1 is, for example, less than 2 μm. The average size D2 is, for example, 2 μm to 15 μm.

$$D1<D2 \quad \text{Formula (1)}$$

$$D1\leq D2/2 \quad \text{Formula (2)}$$

The average size of crystal grains can be measured by, for example, the EBSD (Electron Back Scatter Diffraction Patterns) method. The EBSD method is an application of crystal analysis by electron scanning microscopy (SEM). In the EBSD method, an electron beam is applied on a sample (crystal grains) to be analyzed. The applied electrons become diffracted as they diffuse in the sample (crystal grains), and the diffraction pattern of the reflected electrons released from the sample (crystal grains) is projected onto a detector surface. The crystal orientation can then be analyzed from the projected pattern. Here, the crystal grains in the sample can be identified by, for example, using different colors for different crystal orientations. This enables a measurement of average crystal grain size. Specifically, the average crystal grain size is measured by Area Fraction method. This method determines the areas of crystal grains, and a weighted mean value is determined from the area ratio in an observed region. The grain size (diameter) is determined as the diameter of a circle having the same area as the crystal grain.

When the metal substrate 410 is composed of a stainless steel such as SUS316 and SUS304, the outlet edge Ea is configured of martensite, and the surrounding region Eb is configured of austenite. The thickness of the metal substrate 410 is chosen to be 30 μm to 80 μm, typically about 50 μm from the viewpoint of ease of press working with a punch 200 (described later), and ease of ejection control by the actuator plate 42. The outlet edge Ea has a sag, and is rounded in shape. The inlet Hin also has a sag at its edge, and the edge is rounded in shape.

Actuator Plate 42

The actuator plate 42 is a plate composed of, for example, a piezoelectric material such as PZT (lead zirconate titanate). The actuator plate 42 is what is generally called a chevron-type actuator, which is formed by laminating two piezoelectric substrates of different polarization directions in Z direction. The actuator plate 42 may be a cantilever-type actuator formed of a single piezoelectric substrate of a unidirectional polarization direction along the thickness direction (Z-axis direction). As shown in FIGS. 3 and 4, the actuator plate 42 has two rows of channels (channel rows 421 and 422) extending along X-axis direction. The channel rows 421 and 422 are disposed by being separated from each other in Y-axis direction by a predetermined distance.

The actuator plate 42 has an ejection region (jet region) A1 for the ink 9, provided at the central portion (the region where the channel rows 421 and 422 are formed) relative to X-axis direction, as shown in FIG. 4. The actuator plate 42 also has a non-ejection region (non-jet region) A2 for the ink 9, provided at the both end portions (the region where the channel rows 421 and 422 are not formed) relative to X-axis direction. The non-ejection region A2 is on the outer side of the ejection region A1 relative to X-axis direction. The regions at the both ends of the actuator plate 42 in Y-axis direction constitute tail portions 420.

As illustrated in FIGS. 3 and 4, the channel rows 421 have a plurality of channels C1 extending in Y-axis direction. The channels C1 are disposed side by side, parallel to each other, by being separated from each other in X-axis direction by a predetermined distance. The channels C1 are defined by drive walls Wd of the piezoelectric body (actuator plate 42), and form grooves of a depressed shape as viewed in a cross section (see FIG. 3).

As with the case of the channel rows 421, the channel rows 422 have a plurality of channels C2 extending in Y-axis direction. The channels C2 are disposed side by side, parallel to each other, by being separated from each other in X-axis direction by a predetermined distance. The channels C2 are defined by the drive walls Wd, and form grooves of a depressed shape as viewed in a cross section.

As illustrated in FIGS. 3 and 4, the channels C1 include the ejection channels C1*e* for ejecting the ink 9, and dummy channels C1*d* that do not eject the ink 9. In the channel rows 421, the ejection channels C1*e* and the dummy channels C1*d* are alternately disposed in X-axis direction. The ejection channels C1*e* are in communication with the nozzle holes H1 of the nozzle plate 41, whereas the dummy channels C1*d* are covered from below by the top surface of the nozzle plate 41, and are not in communication with the nozzle holes H1.

As with the case of the channels C1, the channels C2 include the ejection channels C2*e* for ejecting the ink 9, and dummy channels C2*d* that do not eject the ink 9. In the channel rows 422, the ejection channels C2*e* and the dummy channels C2*d* are alternately disposed in X-axis direction. The ejection channels C2*e* are in communication with the nozzle holes H2 of the nozzle plate 41, whereas the dummy channels C2*d* are covered from below by the top surface of the nozzle plate 41, and are not in communication with the nozzle holes H2.

As illustrated in FIG. 4, the ejection channels C1*e* and the dummy channels C1*d* of the channels C1 are alternately disposed with respect to the ejection channels C2*e* and the dummy channels C2*d* of the channels C2. That is, in the inkjet head 4 of the present embodiment, the ejection channels C1*e* of the channels C1, and the ejection channels C2*e* of the channels C2 are disposed in a staggered fashion. As illustrated in FIG. 3, shallow grooves Dd that are in communication with the outer end portions of the dummy channels C1*d* and C2*d* along Y-axis direction are formed in portions of the actuator plate 42 corresponding to the dummy channels C1*d* and C2*d*.

As illustrated in FIGS. 3 and 5, drive electrodes Ed extending in Y-axis direction are provided on the opposing inner surfaces of the drive walls Wd. The drive electrodes Ed include common electrodes Edc provided on inner surfaces facing the ejection channels C1*e* and C2*e*, and active electrodes Eda provided on inner surfaces facing the dummy channels C1*d* and C2*d*. As illustrated in FIG. 5, the drive electrodes Ed (common electrodes Edc and active electrodes Eda) on the inner surfaces of the drive walls Wd have the same depth as the drive walls Wd (the same depth in Z-axis direction). In the actuator plate 42, an insulating film 42A for preventing electrical shorting between the drive electrodes Ed and the nozzle plate 41 is formed on the surface facing the nozzle plate 41. When the actuator plate 42 is the above-described cantilever-type actuator, the drive electrodes Ed (common electrodes Edc and the active electrodes Eda) are formed about a halfway through the depth (Z-axis direction) of the drive walls Wd on the inner surfaces.

A pair of opposing common electrodes Edc in the same ejection channel C1*e* (or the same ejection channel C2*e*) are electrically connected to each other via a common terminal (not illustrated). A pair of opposing active electrodes Eda in the same dummy channel C1*d* (or the same dummy channel C2*d*) are electrically isolated from each other. On the other hand, a pair of opposing active electrodes Eda in the same ejection channel C1*e* (or the same ejection channel C2*e*) are electrically connected to each other via an active terminal (not illustrated).

As illustrated in FIG. 3, flexible printed boards 44 that electrically connect the drive electrodes Ed to a control section (a control section 40 for the inkjet heads 4; described later) are mounted on the tail portions 420. The wiring patterns (not illustrated) formed on the flexible printed boards 44 are electrically connected to the common terminal and the active terminal. This enables the control section 40 to apply a drive voltage to each drive electrode Ed via the flexible printed boards 44.

Cover Plate 43

As illustrated in FIG. 3, the cover plate 43 is disposed so as to close the channels C1 and C2 (the channel rows 421 and 422) of the actuator plate 42. Specifically, the cover plate 43 has a plate-shaped structure bonded to the top surface of the actuator plate 42.

As shown in FIG. 3, the cover plate 43 has a pair of inlet-side common ink chambers 431*a* and 432*a*, and a pair of outlet-side common ink chambers 431*b* and 432*b*. Specifically, the inlet-side common ink chamber 431*a* and the outlet-side common ink chamber 431*b* are formed in regions corresponding to the channel rows 421 (the plurality of channels C1) of the actuator plate 42. The inlet-side common ink chamber 432*a* and the outlet-side common ink chamber 432*b* are formed in regions corresponding to the channel rows 422 (the plurality of channels C2) of the actuator plate 42.

The inlet-side common ink chamber 431*a* has a depressed groove shape, and is formed in the vicinity of the inner end portion of the channels C1 relative to Y-axis direction. A supply slit Sa is formed in a region of the inlet-side common ink chamber 431*a* corresponding to the ejection channel C1*e*, through the thickness (Z-axis direction) of the cover plate 43. Similarly, the inlet-side common ink chamber 432*a* has a depressed groove shape, and is formed in the vicinity of the inner end portion of the channels C2 relative to Y-axis direction. The supply slit Sa is also formed in a region of the inlet-side common ink chamber 432*a* corresponding to the ejection channel C2*e*. The inlet-side common ink chambers 431*a* and 432*a* constitute an inlet portion Tin of the inkjet head 4.

As illustrated in FIG. 3, the outlet-side common ink chamber 431*b* has a depressed groove shape, and is formed in the vicinity of the outer end portion of the channels C1 relative to Y-axis direction. A discharge slit Sb is formed in a region of the outlet-side common ink chamber 431*b* corresponding to the ejection channel C1*e*, through the thickness of the cover plate 43. Similarly, the outlet-side common ink chamber 432*b* has a depressed groove shape, and is formed in the vicinity of the outer end portion of the channels C2 relative to Y-axis direction. The discharge slit Sb is also formed in a region of the outlet-side common ink chamber 432*b* corresponding to the ejection channel C2*e*. The outlet-side common ink chambers 431*b* and 432*b* constitute an outlet portion Tout of the inkjet head 4.

That is, the inlet-side common ink chamber 431*a* and the outlet-side common ink chamber 431*b* are in communication with the ejection channels C1*e* via the supply slits Sa and the discharge slits Sb, and are not in communication with the dummy channels C1*d*. In other words, the dummy channels C1*d* are closed by the bottom portions of the inlet-side common ink chamber 431*a* and the outlet-side common ink chamber 431*b*.

Similarly, the inlet-side common ink chamber 432*a* and the outlet-side common ink chamber 432*b* are in communication with the ejection channels C2*e* via the supply slits Sa and the discharge slits Sb, and are not in communication with the dummy channels C2*d*. In other words, the dummy channels C2*d* are closed by the bottom portions of the inlet-side common ink chamber 432*a* and the outlet-side common ink chamber 432*b*.

Control Section 40

As illustrated in FIG. 2, the control section 40 for controlling various operations of the printer 1 is provided in the inkjet head 4 of the present embodiment. The control section 40 controls, for example, the operation of various components, such as the delivery pumps 52*a* and 52*b*, in addition to controlling the recording operation of the printer 1 recording an image, texts, and the like (the operation of the inkjet head 4 ejecting the ink 9). The control section 40 is configured from, for example, a microcomputer that includes an arithmetic processing unit, and a memory section including various types of memory.

Basic Operation of Printer 1

The printer 1 records (prints) an image, texts, and the like on recording paper P in the manner described below. As an initial state, it is assumed here that the four ink tanks 3 (3Y, 3M, 3C, and 3B) shown in FIG. 1 contain inks of corresponding (four) colors in sufficient amounts. Initially, the inkjet heads 4 have been charged with the inks 9 from the ink tanks 3 through the circulation mechanism 5.

In such an initial state, activating the printer 1 rotates the grid rollers 21 of the transport mechanisms 2*a* and 2*b*, and transports recording paper P between the grid rollers 21 and the pinch rollers 22 in a transport direction d (X-axis direction). Simultaneously with this transport operation, the drive motor 633 of the drive mechanism 63 rotates the pulleys 631*a* and 631*b* to move the endless belt 632. In response, the carriage 62 moves back and forth in the width direction (Y-axis direction) of the recording paper P by being guided by the guide rails 61*a* and 61*b*. Here, the inkjet heads 4 (4Y, 4M, 4C, and 4B) appropriately eject the inks 9 of four colors onto the recording paper P to record images, texts, and the like on the recording paper P.

Detailed Operation of Inkjet Head 4

The operation of the inkjet head 4 (inkjet operation for the ink 9) is described below in detail, with reference to FIGS. 1 to 5. The inkjet head 4 of the present embodiment (a side-shoot, circulatory inkjet head) ejects the ink 9 in shear mode, as follows.

In response to the carriage 62 (see FIG. 1) having started its reciprocal movement, the control section 40 applies a drive voltage to the drive electrodes Ed (common electrodes Edc and active electrodes Eda) of the inkjet head 4 via the flexible printed boards 44. Specifically, the control section 40 applies a drive voltage to the drive electrodes Ed disposed on the pair of drive walls Wd defining the ejection channels C1*e* and C2*e*. This causes the pair of drive walls Wd to deform outwardly toward the dummy channels C1*d* and C2*d* adjacent to the ejection channels C1*e* and C2*e* (see FIG. 5).

That is, the ejection channels C1*e* and C2*e* increase their volume as a result of the flexural deformation of the pair of drive walls Wd. The ink 9 stored in the inlet-side common ink chambers 431*a* and 432*a* is guided into the ejection channels C1*e* and C2*e* as the volume of the ejection channels C1*e* and C2*e* increases (see FIG. 3).

The ink 9 guided into the ejection channels C1*e* and C2*e* creates a pressure wave, and propagates into the ejection channels C1*e* and C2*e*. The drive voltage applied to the drive electrodes Ed becomes 0 (zero) volt at the timing when the pressure wave reaches the nozzle holes H1 and H2 of the nozzle plate 41. In response, the drive walls Wd return to their original shape from the flexurally deformed state, bringing the ejection channels C1*e* and C2*e* back to their original volume (see FIG. 5).

The pressure inside the ejection channels C1*e* and C2*e* increases, and pressurizes the ink 9 inside the ejection channels C1*e* and C2*e* as the volume of the ejection channels C1*e* and C2*e* is restored. This causes the ink 9 to be ejected to outside (toward the recording paper P) in the form of droplets through the nozzle holes H1 and H2 (see FIG. 5). The inkjet head 4 ejects (discharges) the ink 9 in this manner, and records images, texts, and the like on the recording paper P. The ink 9 can be ejected in a straight line (good straight-line stability) at high speed because of the tapered shape of the nozzle holes H1 and H2 of the present embodiment of gradually decreasing diameter toward the bottom (see FIG. 5). This enables high-quality recording.

Manufacturing Method of Nozzle Plate 41

Figure 7A:
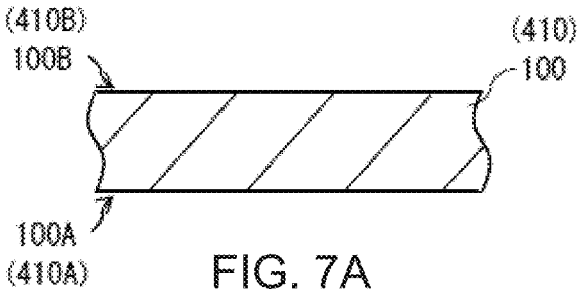
FIG. 7A is a cross sectional view representing an example of a manufacturing step of the nozzle plate according to an embodiment.
Figure 7B:
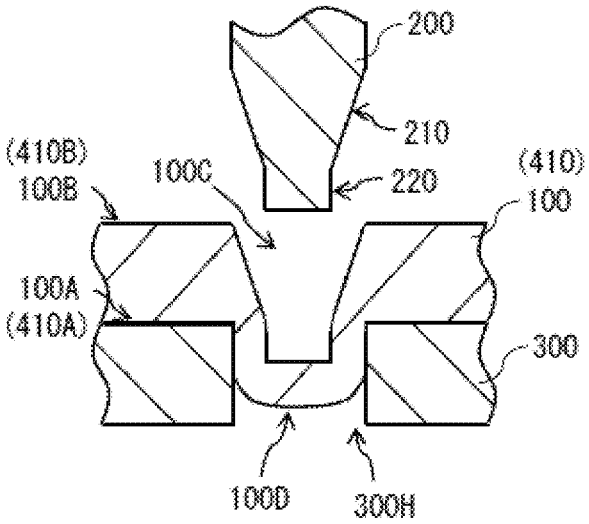
FIG. 7B is a cross sectional view representing an example of a manufacturing step after FIG. 7A.
Figure 7C:
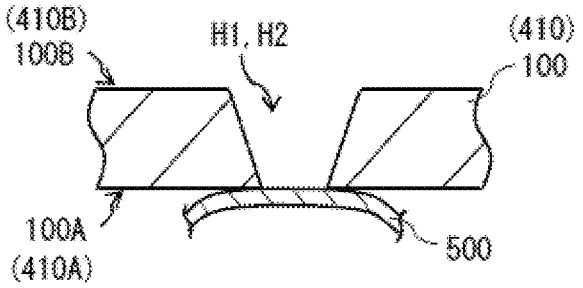
FIG. 7C is a cross sectional view representing an example of a manufacturing step after FIG. 7B.

A method for manufacturing the nozzle plate 41 is described below. FIGS. 7A to 7C are cross sectional views representing an example of manufacturing steps of the nozzle plate 41.

First, a metal substrate 100 is prepared (FIG. 7A). The metal substrate 100 is formed of a stainless steel such as SUS316 and SUS304. The metal substrate 100 has a first principal surface 100A on one side, and a second principal surface 100B on the other side. The metal substrate 100 becomes the metal substrate 410 after working. The first principal surface 100A of the metal substrate 100 is the surface that becomes the outlet-side principal surface 410A of the metal substrate 410, and the second principal surface 100B of the metal substrate 100 is the surface that becomes the inlet-side principal surface 410B of the metal substrate 410.

The next step is punching. First, the metal substrate 100 is fixed on a die 300 with the second principal surface 100B facing up. The die 300 has a plurality of through holes 300H having the same pitch as the nozzle holes H1 of the nozzle plate 41 in X-axis direction. The through hole 300H has a larger diameter than the cylindrical portion 220 of a punch 200 (described later). The diameter of the through holes 300H, and the diameter of the cylindrical portion 220 are related such that, as a result of punching, a region of the metal substrate 100 surrounding indentations 100C to be described later (a region that becomes the outlet edges Ea in a later step) undergoes a transformation from austenite to martensite. That is, the diameter of the through holes 300H, and the diameter of the cylindrical portion 220 are sized to cause a work-induced martensite transformation.

The second principal surface 100B of the metal substrate 100 is then pressed with one or more punches 200. Specifically, the second principal surface 100B of the metal substrate 100 is pressed with one or more punches 200 in portions facing the through holes 300H. This forms the plurality of indentations 100C in the second principal surface 100B, and, at the same time, raised portions 100D in portions of the first principal surface 100A facing the indentations 100C (FIG. 7B).

The punch 200 has a frustoconical tapered portion 210, and a cylindrical portion 220 formed in contact with an end of the tapered portion 210. The indentation 100C formed under the pressure of the punch 200 therefore has an inverted shape from the shape of the punch 200. Specifically, the indentation 100C has a frustoconical tapered hole portion, and a cylindrical hole portion continuous from the tapered hole portion. The indentation 100C is deeper than the thickness of the metal substrate 100 (the distance between the first principal surface 100A and the second principal surface 100B).

The next step is polishing. Specifically, the raised portions 100D are removed by mechanical polishing to open the indentations 100C, and form the nozzle holes H1 and H2 (FIG. 7C). The mechanical polishing may be performed with, for example, a tape 500 (tape polishing). The tape 500 is, for example, a long polyester film of about 75 μm thick with a plurality of abrasive grains fixed over substantially the whole surface on one side of the film.

There are cases where the pressure of the punch 200 causes a wave near the inlets Hin of the nozzle holes H1 and H2 (end portions of the nozzle holes H1 and H2 on the actuator plate 42 side). In this case, the second principal surface 100B may be flattened by mechanical polishing when removing the raised portions 100D. This produces the substantially flat second principal surface 100B.

As an example, the mechanical polishing may leave a burr at the outlets Hout of the nozzle holes H1. In this case, the metal substrate 100 may be subjected to chemical polishing, electrolytic polishing, or chemical-mechanical polishing to make the outlet edges Ea round in shape. This completes the nozzle plate 41.

Advantages

The following describes advantages of the nozzle plate 41 as a jet hole plate according to an embodiment of the present disclosure.

Printers equipped with inkjet heads are used in a wide range of applications. An inkjet head includes a plurality of laminated plates including a nozzle plate formed with large numbers of nozzle holes, and is configured to eject liquid, specifically, ink, against a target recording medium through the nozzle holes. A long life is generally desired in such a nozzle plate. However, traditional nozzle plates are often cleaned as a part of regular maintenance by wiping the surface where the outlets of the nozzle holes are formed. Here, the friction of wiping may cause damage to the outlets of the nozzle holes, and the life of the nozzle plate may be cut short by the impaired discharge characteristics.

In the nozzle plate 41 according to the present embodiment, the average size D1 of crystal grains in the outlet edges Ea of the nozzle holes H1 and H2 is smaller than the average size D2 of crystal grains in the surrounding regions Eb around the outlet edges Ea in the metal substrate 410 constituting the nozzle plate 41. Because the outlet edge Ea is harder than the surrounding region Eb, the outlet edges Ea are less likely to be damaged even when the surface where the outlets Hout of the nozzle holes H1 and H2 are provided is wiped for cleaning. This makes it possible to provide a longer life for the nozzle plate 41.

In the nozzle plate 41 according to the present embodiment, the harder outlet edges Ea are formed in a region of the metal substrate 410 opposite the inlets Hin in a thickness direction of the metal substrate 410. Because the harder regions extend to regions opposite the inlets Hin, the outlet edges Ea are hardly damaged even when the surface where the outlets Hout of the nozzle holes H1 and H2 are provided is wiped for cleaning. This makes it possible to provide a longer life for the nozzle plate 41.

In the nozzle plate 41 according to the present embodiment, the average size D1 of crystal grains in the outlet edges Ea is equal to or less than half of the average size D2 of crystal grains in the surrounding regions Eb. The crystal grains in the outlet edges Ea can have an average size D1 that is equal to or less than half of the average size D2 of crystal grains in the surrounding regions Eb by setting an appropriate relationship for the punch size and the aperture size of the die 300 when manufacturing the nozzle plate 41 by punching with the punch 200 and the die 300. That is, the outlet edge Ea can be hardened by a relatively simple method. Because the outlet edge Ea is hard, it is hardly damaged even when the surface where the outlets Hout of the nozzle holes H1 and H2 are provided is wiped for cleaning. This makes it possible to provide a longer life for the nozzle plate 41 with a relatively simple method.

When the metal substrate 410 is composed of a stainless steel such as SUS316 and SUS304 in the nozzle plate 41 according to the present embodiment, the outlet edge Ea is configured of martensite, and the surrounding region Eb is configured of austenite. The outlet edge Ea can thus generate martensite when an appropriate relationship is set for the punch size and the aperture size of the die 300 in manufacture of the nozzle plate 41 produced by punching with the punch 200 and the die 300. That is, martensite can be generated in the outlet edge Ea using a relatively simple method. Accordingly, the outlet edges Ea are hardly damaged even when the surface where the outlets Hout of the nozzle holes H1 and H2 are provided is wiped for cleaning. This makes it possible to provide a longer life for the nozzle plate 41 with a relatively simple method.

When the thickness of the metal substrate 410 is 30 μm to 80 μm in the nozzle plate 41 according to the present embodiment, the outlet edge Ea can be hardened by setting an appropriate relationship for the punch size and the aperture size of the die 300 when manufacturing the nozzle plate 41 by punching with the punch 200 and the die 300. That is, the outlet edge Ea can be hardened by a relatively simple method. Because the outlet edge Ea is hard, it is hardly damaged even when the surface where the outlets Hout of the nozzle holes H1 and H2 are provided is wiped for cleaning. This makes it possible to provide a longer life for the nozzle plate 41 with a relatively simple method.

In the nozzle plate 41 according to the present embodiment, the inlet Hin has a round edge. That is, in the present embodiment, the outlet edge Ea has a round shape, in addition to being hard. Accordingly, the outlet edge Ea does not deform as easily as when the outlet edge Ea has an angular shape. This makes deformation unlikely in the outlet edges Ea even when the surface where the outlets Hout of the nozzle holes H1 and H2 are provided is wiped for cleaning. The nozzle plate 41 can therefore remain functional for extended time periods without changing its jet characteristics, and can have a long life.

2. Variations

While the present disclosure has been described through an embodiment, the present disclosure is not limited to the embodiment above, and may be modified in a variety of ways.

While the foregoing exemplary embodiment described exemplary structures (e.g., shapes, positions, and numbers) of different members of the printer 1 and the inkjet head 4, the structures of these and other members are not limited to the ones described in the foregoing embodiment, and these may have other structures, including shapes, positions, and numbers. The values and ranges of various parameters, and the relationships between these parameters described in the foregoing embodiment are also not limited to the ones described in the foregoing embodiment, and the parameters may have different values, ranges and relationships.

Specifically, for example, the foregoing embodiment described the two-row inkjet head 4 (with two rows of nozzles 411 and 412). However, the present disclosure is not limited to this example. Specifically, for example, the inkjet head may be a single-row inkjet head (with a single row of nozzles), or an inkjet head having three or more rows (with three or more rows of nozzles).

For example, the foregoing embodiment described the nozzle rows 411 and 412 extending in a straight line along X-axis direction. However, the present disclosure is not limited to this example. For example, the nozzle rows 411 and 412 may extend in an oblique direction. The shape of the nozzle holes H1 and H2 is also not limited to the circular shape described in the foregoing embodiment, and may be, for example, a polygonal shape such as a triangle, or an elliptical or a star shape.

For example, the foregoing embodiment described the inkjet head 4 of a side shoot-type. However, the present disclosure is not limited to this example. For example, the inkjet head 4 may be of a different type. For example, the foregoing embodiment described the inkjet head 4 as a circulatory inkjet head. However, the present disclosure is not limited to this example. For example, the inkjet head 4 may be a non-circulatory inkjet head.

For example, in the foregoing embodiment, and the variations thereof the die 300 may have a single through hole 300H when a single punch 200 is used for punching. Here, the single punch 200 and the single through hole 300H work as a pair, and can form the plurality of raised portions 100D in a line by moving relative to the metal substrate 410.

The series of processes described in the foregoing embodiment may be performed on hardware (circuit) or software (program). In the case of software, the software is configured as a set of programs that causes a computer to execute various functions. The program may be, for example, a preinstalled program in the computer, and may be installed afterwards in the computer from a network or a recording medium.

The foregoing embodiment described the printer 1 (inkjet printer) as a specific example of a liquid jet recording apparatus of the present disclosure. However, the present disclosure is not limited to this example, and may be applied to devices and apparatuses other than inkjet printers. In other words, a liquid jet head (inkjet head 4) and a jet hole plate (nozzle plate 41) of the present disclosure may be applied to devices and apparatuses other than inkjet printers. Specifically, for example, a liquid jet head and a jet hole plate of the present disclosure may be applied to devices such as facsimile machines, and on-demand printers.

The foregoing embodiment and variations described recording paper P as a target of recording by the printer 1. However, the recording target of a liquid jet recording apparatus of the present disclosure is not limited to this example. For example, texts and patterns can be formed by jetting ink onto various materials such as a boxboard, a fabric, a plastic, and a metal. The recording target is not necessarily required to have a flat surface shape, and a liquid jet recording apparatus of the present disclosure can be used for painting and decoration of various solid objects, including, for example, food products, building materials such as tiles, furniture, and automobiles. A liquid jet recording apparatus of the present disclosure also can print on fibers, or create a solid object by jetting and solidifying ink (i.e., a 3D printer).

The examples described above may be applied in any combinations.

The effects described in the specification are merely illustrative and are not restrictive, and may include other effects.

Further, the present disclosure can also take the following configurations.

<1>

A jet hole plate for use in a liquid jet head, the jet hole plate comprising a metal substrate provided with a plurality of jet holes, wherein in the metal substrate, an average crystal grain size in outlet edges of the jet holes is smaller than that in surrounding regions around the outlet edges.

<2>

The jet hole plate according to <1>, wherein the metal substrate has a first principal surface provided with outlets of the jet holes, and a second principal surface provided with inlets of the jet holes, the inlets being larger than the outlets, and the outlet edges correspond to regions of the metal substrate opposite the inlets in a thickness direction of the metal substrate.

<3>

The jet hole plate according to <1> or <2>, wherein an average crystal grain size in the outlet edges is equal to or less than half of an average crystal grain size in the surrounding regions.

<4>

The jet hole plate according to <1> or <2>, wherein the metal substrate is composed of a stainless steel, the outlet edges are configured of martensite, and the surrounding regions are configured of austenite.

<5>

The jet hole plate according to any one of <1> to <4>, wherein the metal substrate has a thickness of 30 μm to 80 μm.

<6>

The jet hole plate according to any one of <1> to <5>, wherein the outlet edges are rounded in shape.

<7>

A liquid jet head comprising the jet hole plate according to any one of <1> to <6>.

<8>

A liquid jet recording apparatus comprising: the liquid jet head according to <7>; and a container for storing a liquid to be supplied to the liquid jet head.

What is claimed is:

1. A jet hole plate for use in a liquid jet head, the jet hole plate comprising:

a metal substrate provided with a plurality of jet holes, wherein the metal substrate comprises a first principal surface, on which outlet edges of the jet holes are provided, and an opposite second principal surface, wherein the metal substrate comprises smaller crystal grain size regions having an average crystal grain size that is smaller than the crystal grain size of surrounding regions adjacent to the smaller crystal grain size regions, the smaller crystal grain size regions including the outlet edges of the jet holes, and wherein a size of the smaller crystal grain size regions increases from the second principal surface toward the outlet edges of the jet holes in the first principal surface.

2. The jet hole plate according to claim 1, wherein:

the first principal surface is provided with outlets of the jet holes, and the second principal surface is provided with inlets of the jet holes, wherein the inlets are larger than the outlets, and the outlet edges correspond to an area enjoining the smaller crystal grain size regions and the first principal surface.

3. The jet hole plate according to claim 1, wherein an average crystal grain size in the outlet edges is equal to or less than half of an average crystal grain size in the surrounding regions.

4. The jet hole plate according to claim 1, wherein:

the metal substrate is composed of a stainless steel, the outlet edges are configured of martensite, and the surrounding regions are configured of austenite.

5. The jet hole plate according to claim 1, wherein the metal substrate has a thickness of 30 μm to 80 μm.

6. The jet hole plate according to claim 1, wherein the outlet edges are rounded in shape.

7. The jet hold plate according to claim 1, wherein the jet holes are formed by punching.

8. A liquid jet head comprising the jet hole plate according to claim 1.

9. A liquid jet recording apparatus comprising:

the liquid jet head according to claim 8; and a container for storing a liquid to be supplied to the liquid jet head.

* * * * *